US006190146B1

(12) United States Patent
Heggs et al.

(10) Patent No.: US 6,190,146 B1
(45) Date of Patent: Feb. 20, 2001

(54) MEMBER FOR COMPRESSOR, MANUFACTURING METHOD FOR THE MEMBER, AND SCROLL COMPRESSOR

(75) Inventors: Richard Paul Heggs, Dublin; John Paul Frechette, Powell, both of OH (US); Takao Hasegawa, Saitama (JP)

(73) Assignee: Zexel Corporation, Tokyo (JP)

( * ) Notice: Under 35 U.S.C. 154(b), the term of this patent shall be extended for 0 days.

(21) Appl. No.: 09/206,388

(22) Filed: Dec. 7, 1998

(51) Int. Cl.[7] ..... F01C 1/02

(52) U.S. Cl. ..... 418/55.2; 418/152; 264/109; 264/122; 264/DIG. 53; 264/29; 524/494; 524/496

(58) Field of Search ..... 418/55.2, 50, 152; 162/146; 264/109, 122, DIG. 53, 29; 524/494, 496

(56) References Cited

U.S. PATENT DOCUMENTS

| | | | | |
|---|---|---|---|---|
| 3,742,101 | * | 6/1973 | Ouchi et al. | 264/29 |
| 4,548,678 | * | 10/1985 | Laffin et al. | 162/146 |
| 5,124,397 | * | 6/1992 | Kanazawa et al. | 524/496 |
| 5,131,827 | * | 7/1992 | Tasaka | 418/55.2 |

FOREIGN PATENT DOCUMENTS

| | | | |
|---|---|---|---|
| 62-19998 | | 9/1987 | (JP) . |
| 2-112685 | | 4/1990 | (JP) . |
| 2-112688 | | 4/1990 | (JP) . |
| 03115793 | * | 5/1991 | (JP) . |
| 03115794 | * | 5/1991 | (JP) . |
| 4031155793 | * | 5/1991 | (JP) . |
| 4-38944B | | 6/1992 | (JP) . |
| 4-38945B | | 6/1992 | (JP) . |
| 6-33780B | | 5/1994 | (JP) . |
| 8-93690 | | 9/1996 | (JP) . |
| 9-112489 | | 2/1997 | (JP) . |
| 2643476 | | 5/1997 | (JP) . |
| 2643477 | | 5/1997 | (JP) . |

* cited by examiner

*Primary Examiner*—Thomas Denion
*Assistant Examiner*—Thai-Ba Trieu
(74) *Attorney, Agent, or Firm*—Burns, Doane, Swecker & Mathis, LLP

(57) ABSTRACT

A scroll member for scroll compressor contains a phenol aralkyl resin and a glass fiber and has feature that the dimensional change rate of the member is 0.05% or below under a chemical stability test condition conducted in an atmosphere in which a refrigerant and a refrigerating machine oil coexist at a high temperature and a high pressure, thereby making the resin scroll member practical and chemically stable. The scroll member may further contain a phenol resin and/or glass beads. The scroll member may be formed by a heat treatment having stepwise temperature increase of a molded material from an initial temperature range of 120 to 140° C. to a final temperature range of 170 to 177° C. The heat treatment can be implemented sequentially, e.g., for four hours or more at a temperature range of 120 to 140° C., for four hours or more at a temperature range of 140 to 170° C., and for four hours or more at a temperature range of 170 to 177° C.

30 Claims, No Drawings

MEMBER FOR COMPRESSOR, MANUFACTURING METHOD FOR THE MEMBER, AND SCROLL COMPRESSOR

BACKGROUND OF THE INVENTION

1. Field of the Invention

This invention relates to a compressor member such as a scroll member for scroll compressor, to a manufacturing method for the material, and to a scroll compressor.

2. Description of Related Art

Scroll compressors are one type of compressor used in freezing systems or air conditioning systems and are compressors performing compression by means of a stationary scroll and an orbiting scroll that orbits according to rotation of a drive shaft. Any scroll of conventional scroll compressors is made from some iron or aluminum material. Those metal scrolls, however, had a problem causing high costs for production because they require a relatively high precision to be fabricated. Furthermore, the metal scrolls are heavy in weight and therefore raise a problem that the compressors suffer from large energy losses when operating.

Previous inventors have developed scrolls mainly made of a resin suitable to be fabricated and light in weight in comparison with metal scrolls and have proposed various scrolls (e.g., Japanese Unexamined Patent Publication (KOKAI) No. Showa 62-199,981, Japanese Unexamined Patent Publication (KOKAI) No. Heisei 2-112,685, Japanese Unexamined Patent Publication (KOKAI) No. Heisei 2-112,688, Japanese Patent Publication (KOKOKU) No. Heisei 6-33,780).

Those scrolls mainly made of a resin have not yet been practically produced. Although various searches for scroll materials have focused on their resistance against abrasion, research done by this inventor discovered that there were other practical characteristics to be considered in addition to resistance against abrasion. That is, the scrolls in the scroll compressors are in contact with refrigerant and refrigerating machine oil at a high temperature and a high pressure during operation of the compressors. Scrolls mainly made of a resin in contact with the refrigerant and refrigerating machine oil at the high temperature and the high pressure change in dimension, thereby causing a problem in that the scroll prevents the compressor from operating efficiently and possibly makes it inoperable. The research concluded that to make the scroll practical, the scroll needs to be made of a material having dimensional and chemical stability under high temperature and high pressure refrigerant and refrigerating machine oil, as well as abrasion resistance.

Various engineering plastics are considered to be used for some mechanical parts other than scrolls in scroll compressors, and are in fact, used in many fields. Particularly, those are frequently parts of automobiles. For example, known as mainly made of a phenol aralkyl resin are pulleys (e.g., Japanese Patent Publication (KOKOKU) No. Heisei 4-38,944, Japanese Patent Publication (KOKOKU) No. Heisei 4-38,945), rotors for pump (e.g., Publications of U.S. Pat. Nos. 2,643,476 and 2,643,477), and impellers for pump (e.g., Japanese Unexamined Patent Publication (KOKAI) No. Heisei 8-93,690, Japanese Unexamined Patent Publication (KOKAI) No. Heisei 9-112,489).

However, in all of the above cases, no material is selected in consideration for dimensional and chemical stability under high temperature and high pressure refrigerant and refrigerating machine oil, as well as abrasion resistance.

SUMMARY OF THE INVENTION

It is an object of this invention to provide a member for a compressor such as a scroll member mainly made of a resin having good dimensional and chemical stability under high temperature and high pressure refrigerant and refrigerating machine oil, as well as good abrasion resistance, and to provide a scroll compressor made with such a scroll member.

The foregoing object is accomplished by a member for a compressor containing a phenol group resin and a reinforcing material and having the desirable characteristic that the dimensional change of the member is 0.05% or below under a chemical stability test condition conducted in an atmosphere in which a refrigerant and a refrigerating machine oil coexist at a high temperature and a high pressure (hereinafter referred to a compressor member (1)). The phenol group resin is made of either a phenol aralkyl resin or a combination of a phenol aralkyl resin and a phenol resin. The reinforcing material is made of either a glass or other fiber or a combination of a glass fiber and glass beads or other inert filler. In another aspect of the invention, a member for compressor contains a phenol group resin and a glass material and is formed by heat treatment having stepwise temperature increase of a molded material from an initial temperature range of 120 to 140° C. to a final temperature range of 170 to 177° C. (hereinafter referred to a compressor member (2)). Such a member can be a member for, e.g., scroll compressor.

A method to form a scroll member in a scroll compressor includes steps of molding a mixture containing a phenol aralkyl resin and a glass fiber, and implementing a heat treatment under a condition that the dimensional change rate of the member is 0.05% or below under a chemical stability test condition implemented in an atmosphere in which a refrigerant and a refrigerating machine oil coexist at a high temperature and a high pressure.

This invention also concerns a scroll compressor in which at least one of the scroll members constituting a compression chamber is made of the above scroll member or made by the above method.

DESCRIPTION OF PREFERRED EMBODIMENTS

Compressor Member (1)

A compressor member (1) according to the invention includes a phenol aralkyl resin and a glass fiber and has the desirable feature that the dimensional change rate of the member is 0.05% or below under a chemical stability test condition in an atmosphere in which a refrigerant and a refrigerating machine oil coexist at a high temperature and a high pressure. The phrase "chemical stability test condition in an atmosphere in which a refrigerant and a refrigerating machine oil coexist at a high temperature and a high pressure" indicates, as described in the following Examples, a condition in which, the refrigerant gas pressure shows 3.6 MPa at 150° C. where polyalkylene glycol refrigerating machine oil and HFC 134a refrigerant exist. This condition is similar to a running condition of an actual compressor or more extreme than the running condition. This is designed to simulate circumstances in an actual compressor in which a refrigerating machine oil is used to lubricate scroll walls where a refrigerant and a refrigerating machine oil coexist at a high temperature and a high pressure exceeding a maximum temperature (150° C.) and the critical point around a high pressure chamber and an outlet at which a more extreme condition is anticipated to be formed.

Under such a condition, when the compressor member (1) is a scroll member for a scroll compressor, the scroll member becomes practical when its dimensional change rate is 0.05% or below. The term "dimensional change" herein means shrinkage, which is preferably 0.04% or below, and more preferably 0.03% or below.

The phenol aralkyl resin is a resin obtained from condensation reaction between a phenolic compound and an aralkyl ether. The phenol aralkyl resin can be a monovalent phenol aralkyl resin or a bivalent phenol aralkyl resin depending on the number of hydroxide groups in the phenol portion. In this invention, the phenol aralkyl resin is not particularly limited and can be made of a commercially available resin as it is. As a phenol aralkyl resin, Milex (trademark) XL-225 or 325 made by Mitsui Chemicals, Inc., or the like is an example of this type of resin but this invention is not limited to this resin.

The glass fiber is generally used as a material for reinforcing resins and has no specific limitation in its size or composition. For example, fibers having a fiber diameter of about 15 microns and a fiber length of 200 to 500 microns, which are generally used as a reinforcing material for resin, can be used. Its glass composition is not limited specifically, and, e.g., alkali free glass (E-Glass) or highly strengthened glass (S-Glass) can be used.

In such a composition member, it is proper that the contained amount of the phenol aralkyl resin is 25 to 35% by weight and that the contained amount of the glass fiber is 75 to 55% by weight, to achieve high chemical stability, low molding shrinking rate, injection molding capability, and excellency in required mechanical properties. If the contained amount of the phenol aralkyl resin is less than 25% by weight, the member makes injection molding significantly harder. If the contained amount of the phenol aralkyl resin exceeds 35% by weight, the member likely fails to get the required chemical stability as well as suffers from a large molding shrinkage rate, thereby making more difficult dimensional control during molding. If the contained amount of the glass fiber exceeds 75% by weight, the member makes injection molding significantly harder. If the contained amount of the glass fiber is less than 55% by weight, the member likely suffers from a large molding shrinkage rate, makes more difficult dimensional control during molding and loses its mechanical strength.

The member (1) according to the invention may further contain glass beads. The glass beads are generally used as a material for filling resins and has no specific limitation in its size or the like. Glass beads commercially available can be used as they are. For example, beads having a mean particle diameter of about 30–50 microns can be used. Its glass composition is not limited specifically, and, e.g., alkali free glass (F-Glass) or highly strengthened glass (S-Glass) can be used.

In such a composition member, it is proper that the contained amount of the phenol aralkyl resin is 25 to 35% by weight and that the total contained amount of the glass fiber and the glass beads is 75 to 55% by weight, to achieve high chemical stability, low molding shrinking rate, injection molding capability, and excellency in required mechanical properties. If the contained amount of the phenol aralkyl resin is less than 25% by weight, the member makes injection molding significantly harder. If the contained amount of the phenol aralkyl resin exceeds 35% by weight, the member likely fails to get the required chemical stability as well as suffers from a large molding shrinkage rate, thereby making more difficult dimensional control during molding. If the total contained amount of the glass fiber and the glass beads exceeds 75% by weight, the member makes injection molding significantly harder. If the total contained amount of the glass fiber and the glass beads is less than 55% by weight, the member likely suffers from a large molding shrinkage rate, makes more difficult dimensional control during molding, and loses its mechanical strength. It is desirable to make the member contain the glass fiber in a percentage equal to or more than the glass beads in order to achieve high mechanical strength.

The member (1) according to the invention may further contain phenol resin. For example, a novolac phenol resin and resol phenol resin can be used. There is no special limitation to the phenol resin, and phenol resins commercially available can be used as they are.

When the member (1) further contains phenol resin, it is desirable to form the member with the total contained amount of the phenol aralkyl resin and the phenol resin of 25 to 35% by weight and with the contained amount of the glass fiber or the total contained amount of the glass fiber and the glass beads of 55 to 75% by weight from the same reason to the above description. It is also desirable to set the contained amount of the phenol resin equal to or less than twice of the contained amount of the phenol aralkyl resin in an aspect to achieve an increased effect of chemical stability in the phenol aralkyl resin. In this case, it is desirable to set the contained amount of the glass fiber is equal to or more than the contained amount of the glass beads.

Compressor Member (2)

A compressor member (2) according to the present invention is one that can be obtained by a heat treatment having stepwise temperature increase of the member that is obtained through molding from a material containing the phenol aralkyl resin and the glass fiber, from an initial temperature range of 120 to 140° C. to a final temperature range of 170 to 177° C. The heat treatment of such a schedule can give the molded member excellent chemical stability. The term "chemical stability" herein means the dimensional change rate is 0.05% or less under the chemical stability test condition conducted in an atmosphere in which a refrigerant and a refrigerating machine oil coexist at a high temperature and a high pressure. The term "molding" herein can be injection molding, compression molding, or injection-compression molding, etc.

Setting the initial temperature of the heat treatment in a range of 120 to 140° C. brings an advantage to prevent defects such as void formation from occurring by gently discharging gas components that have been created by reactions during the molding and remained in the molded body, as well as not yet reacted components that may generate gas species upon their degradation. Setting the final temperature of the heat treatment in a range of 170 to 177° C. provides an adequate material strength even in the maximum temperature circumstance in the compressor and chemical stability over an extended period of time. The range is also advantageous to prevent defects from occurring that easily occur in a heat treatment done at a temperature exceeding 177° C.

A specific schedule of the heat treatment is, e.g., first, four hours or more at a temperature range of 120 to 140° C.; second, four hours or more at a temperature range of 140 to 170° C.; and third, four hours or more at a temperature range of 170 to 177° C., and implemented in an order to increase the temperature of the treatment. In the heat treatment of the first step, the member is subject to the heat treatment at the temperature range of 120 to 140° C. for, preferably, 4 to 8 hours. If the time is too short, discharges ot remaining gas components and gas components derived from not yet reacted components tends to become insufficient, and if too long, the heat treatment will take a longer time, thereby reducing productivity and economic aspects (though having no detrimental effect on material properties). In the heat treatment of the second step, the member is subject to the heat treatment at a the temperature range of 140 to 170° C. for, preferably, 4 to 8 hours. If the time is too short, discharges of gases become inadequate, thereby likely causing the member to suffer from defects such as voids during the process at the final temperature, and if too long, the heat treatment take a longer time, thereby reducing productivity and economic aspects (though having no detrimental effect on material properties). Moreover, in the second step of the heat treatment, the treatment time is preferably for four hours or more in total of the two temperature ranges, e.g., a temperature range of 140 to 160° C. and a temperature range of 150 to 170° C. The heat treatment time is, more preferably, for 2 to 4 hours in the temperature range of 140 to 160° C. and for 2 to 4 hours in the temperature range of 150 to 170° C.

In the compressor member (2) of the present invention, the phenol aralkyl resin is a resin obtained from condensation reaction between a phenolic compound and an aralkyl ether. The phenol aralkyl resin can be a monovalent phenol aralkyl resin and a bivalent phenol aralkyl resin depending on the number of hydroxide groups in the phenol portion. In this invention, the phenol aralkyl resin is not particularly limited and can be made of a commercially available resin as it is. As a phenol aralkyl resin, Milex (trademark) XL-225 or 325 made by Mitsui Chemicals, Inc., is an example of this type of resin but this invention is not limited to this resin.

The glass fiber is generally used as a material for reinforcing resins and has no specific limitation in its size or composition. For example, fibers having a fiber diameter of about 15 microns and a fiber length of 200 to 500 microns, which are generally used as a reinforcing material for resin, can be used. Its glass composition is not limited specifically, and, e.g., alkali free glass (E-Glass) or highly strengthened glass (S-Glass) can be used.

In such a composition member, it is proper that the contained amount of the phenol aralkyl resin is 25 to 35% by weight and that the contained amount of the glass fiber is 75 to 55% by weight, to achieve high chemical stability, low molding shrinking rate, injection molding capability, and excellency in required mechanical properties. If the contained amount of the phenol aralkyl resin is less than 25% by weight, the member makes injection molding significantly harder. If the contained amount of the phenol aralkyl resin exceeds 35% by weight, the member likely fails to get the required chemical stability as well as suffers from a large molding shrinkage rate, thereby making more difficult dimensional control during molding. If the contained amount of the glass fiber exceeds 75% by weight, the member makes injection molding significantly harder. If the contained amount of the glass fiber is less than 55% by weight, the member likely suffers from a large molding shrinkage rate, makes dimensional control more difficult during molding, and the member loses its mechanical strength.

The member (2) according to the invention may further contain glass beads. The glass beads are generally used as a material for reinforcing resins and has no specific limitation in its size or composition. Glass beads commercially available can be used as they are. For example, beads having a mean particle diameter of about 30–50 microns can be used. Its glass composition is not limited specifically, and, e.g., alkali free glass (E-Glass) or highly strengthened glass (S-Glass) can be used.

In such a composition member, it is proper that the contained amount of the phenol aralkyl resin is 25 to 35% by weight and that the total contained amount of the glass fiber and the glass beads is 75 to 55% by weight, to achieve high chemical stability, low molding shrinking rate, injection molding capability, and excellency in required mechanical properties. If the contained amount of the phenol aralkyl resin is less than 25% by weight, the member makes injection molding significantly harder. If the contained amount of the phenol aralkyl resin exceeds 35% by weight, the member likely fails to get the required chemical stability as well as suffers from a large molding shrinkage rate, thereby making more difficult dimensional control during molding. If the total contained amount of the glass fiber and the glass beads exceeds 75% by weight, the member makes injection molding significantly harder. If the total contained amount of the glass fiber and the glass beads is less than 55% by weight, the member likely suffers from a large molding shrinkage rate, makes more difficult dimensional control during molding, and loses its mechanical strength. It is desirable to make the member contain glass fiber in a percentage equal to or more than the glass beads in order to achieve high mechanical strength.

The member (2) according to the invention may further contain phenol resin. For example, a novolac phenol resin and resol phenol resin can be used. There is no special limitation to the phenol resin, and phenol resins commercially available can be used as they are.

When the member (2) further contains phenol resin, it is desirable to form the member with the total contained amount of the phenol aralkyl resin and the phenol resin of 25 to 35% by weight and with the contained amount of the glass fiber or the total contained amount of the glass fiber and the glass beads of 55 to 75% by weight from the same reason to the above description. It is also desirable to set the contained amount of the phenol resin equal to or less than twice of the contained amount of the phenol aralkyl resin in order to achieve an increased effect of chemical stability in the phenol aralkyl resin. In this case, it is desirable to set the contained amount of the glass fiber is equal to or more than the contained amount of the glass beads.

The compressor members (1) and (2) according to the invention is applicable to, e.g., a scroll member for scroll compressor. As a member other than the scroll member for scroll compressor to which this invention is applicable, a piston for reciprocal type compressor, or a member constituting a compression chamber of a rotary compressor, etc. are exemplified.

Manufacturing Method

Now, a manufacturing method for the member for compressor is described. The invented method has a feature that, where a mixture containing a phenol aralkyl resin and a glass fiber is molded and subjected to a heat treatment to manufacture the scroll member, the heat treatment is conducted under a condition that the dimensional change rate of the member is 0.05% or below under a chemical stability test condition conducted in an atmosphere in which a refrigerant and a refrigerating machine oil coexist at a high temperature and a high pressure. The phrases "chemical stability test condition conducted in the atmosphere in which the refrigerant and the refrigerating machine oil coexist at the high temperature and the high pressure" and "dimensional change rate which is 0.05% or below" are as described above. The term "molding" is, for example, injection molding, compression molding, or injection compression molding, etc. Tile phenol aralkyl resin and the glass fiber used for molding can contain glass beads, and the composition ratio of the mixture of those and other components are as described above.

The resin mixture may contain a crosslinking promoting agent. Para-toluene sulfonic acid, salicylic acid, compounds of alkaline earth metal such as magnesium, etc. are exemplified as a crosslinking promoting agent for the phenol aralkyl resin. The amount of the crosslinking promoting agent is properly set to 0 to 4 parts by weight where the phenol aralkyl resin of 100 parts by weight (if the phenol resin is mixed, the phenol aralkyl resin and the phenol resin of 100 parts by weight in total) is used. As a crosslinking agent generally used for novolac phenol resin, hexamine (official name "hexamethylenetetramine") can be used. In such a case, a proper amount is in a range of 8 to 14 parts by weight where the resin in total is 100 parts by weight.

Some lubricants (e.g., stearic acid or its salts (eg. Calcium Stearate)), coloring agents, coupling agents, plasticizers, etc., other than the above crosslinking promoting agents, are properly added as far as they do not impair the physical property of the invented member.

To make the dimensional change rate 0.05% or below under a chemical stability test condition conducted in an atmosphere in which a refrigerant and a refrigerating machine oil coexist at a high temperature and a high pressure, the heat treatment has a series of stepwise temperature increases of a member, e.g., from an initial temperature range of 120 to 140° C. to a final temperature range of 170 to 177° C. Setting the initial temperature of the heat treatment in a range of 120 to 140° C. brings an advantage to prevent defects such as voids from occurring by gently discharging gas components that have created by reactions during the molding and remained in the molded body, as well as not yet reacted components that may generate gas species upon their degradation. Setting the final temperature of the heat treatment in a range of 170 to 177° C. creates an adequate material strength even in the maximum temperature circumstance in the compressor and a chemical stability over a long period of time. The range is also advantageous to prevent defects from occurring that easily occur in a heat treatment done at a temperature exceeding 177° C.

As described above, a specific schedule of the heat treatment is, e.g., first, four hours or more at a temperature range of 120 to 140° C.; second, four hours or more at a temperature range of 140 to 170° C.; and third, four hours or more at a temperature range of 170 to 177° C., and implemented in an order to increase the temperature of the treatment. In the heat treatment of the first step, the member is subject to the heat treatment at the temperature range of 120 to 140° C. for, preferably, 4 to 8 hours. If the time is too short, discharges of remaining gas components and gas components derived from not yet reacted components tends to become insufficient, and if too long, the heat treatment will take a longer time, thereby reducing productivity and economic aspects (though having no detrimental effects on material properties). In the heat treatment of the second step, the member is subject to the heat treatment at a the temperature range of 140 to 170° C. for, preferably, 4 to 8 hours. If the time is too short, discharges of gases become inadequate, thereby likely causing the member to suffer from defects such as voids during the process at the final temperature, and if too long, the heat treatment will take a longer time, thereby reducing productivity and economic aspects (though having no detrimental effects on material properties). Moreover, in the second step of the heat treatment, the treatment time is preferably for four hours or more in total of the two temperature ranges, e.g., a temperature range of 140 to 160° C. and a temperature range of 150 to 170° C. The heat treatment time is, more preferably, for 2 to 4 hours in the temperature range of 140 to 160° C. and for 2 to 4 hours in the temperature range of 150 to 170° C.

The invented scroll compressor has a feature that at least one of scroll members constituting the compression chamber is the invented scroll member or the scroll member manufactured by the invented method. The structure of the scroll compressor can be known, and for example, Japanese Unexamined Patent Publication (KOKAI) No. Showa 62-199, 981, Japanese Unexamined Patent Publication (KOKAI) No. Heisei 2-112,685, Japanese Unexamined Patent Publication (KOKAI) No. Heisei 2-112,688, and Japanese Patent Publication (KOKOKU) No. Heisei 6-33,780 can be used as references. The scroll compressor according to the invention preferably has both scroll members constituting the compression chamber as invented scroll members or the scroll members manufactured by the invented method.

EXAMPLES

Hereinafter, the invention is described in detail based on the following Examples.

Mixtures containing phenol aralkyl resin XL225MB (low molecular weight type: indicated in Table 1 as "A") and XL325M (high molecular weight type: indicated in Table 1 as "B"), novolac type phenol resin, glass fiber (fiber diameter of 13 to 20 microns and fiber length of 50 to 500 microns), glass beads (mean particle diameter of 30 to 50 microns) and catalysts (hexamine, p-toluene sulfonic acid or salicylic acid as a setting promoting agent) and having compositions shown in Table 1 were prepared by preliminarily mixing them and molded by injection molding method after mixing and grinding the mixtures. The obtained specimens were subject to a heat treatment with a schedule of eight hours at 120° C., four hours at 150° C., four hours at is 165° C., and sixteen hours at 177° C. The obtained sample pieces (125×12.5×3.5 mm) were examined in the following manner for their chemical stability and the results are listed in Table 1B.

In addition, chemical stability of specimens having the same formulation as that of Example 7, 8, 9 or 10 and subjected to a heat treatment with a schedule of either (A) eight hours at 120° C., four hours at 150° C., and four hours at 165° C., or (B) eight hours at 120° C., four hours at 150° C., and four hours at 165° C. and four hours at 177° C., or (D) four hours at 120° C., four hours at 150° C., and four hours at 165° C. and four hours at 180° C. is also listed in Table 2 together with the results of Examples 7, 8, 9 and 10 (7C, 8C, 9C and 10C).

Test Method for Chemical Stability

The sample pieces are heated at 150° C. in an autoclave in which polyalkylene glycol refrigerating machine oil and HFC134a refrigerant were enclosed. The refrigerating machine oil was normally supplied in a splashing manner to the sample pieces by successive stirring at refrigerant gas pressure of 3.6 MPa to keep the surfaces of the sample pieces always in a wet state by the refrigerating machine oil. The pieces were held for seven days. The length of the sample pieces before and after the test were measured and evaluated.

TABLE 1A

| | Phenolic [wt %] | Phenolic type | Phenol aralkyl [wt %] | Phenol aralkyl type | Total resin [wt %] | Phenol aralkyl ratio [%] |
|---|---|---|---|---|---|---|
| Example 1 | 0 | — | 25 | A | 25 | 100 |
| Example 2 | 0 | — | 25 | B | 25 | 100 |
| Example 3 | 0 | — | 25 | A | 25 | 100 |
| Example 4 | 0 | — | 25 | B | 25 | 100 |
| Example 5 | 0 | — | 25 | A | 25 | 100 |
| Example 6 | 0 | — | 28 | B | 28 | 100 |
| Example 7 | 0 | — | 28 | A | 28 | 100 |
| Example 8 | 7 | N | 21 | A | 28 | 75 |
| Example 9 | 0 | — | 28 | B | 28 | 100 |
| Example 10 | 0 | — | 28 | A | 28 | 100 |
| Example 11 | 14 | N | 14 | A | 28 | 50 |
| Example 12 | 14 | N | 14 | A | 28 | 50 |
| Example 13 | 14 | N | 14 | A | 28 | 50 |
| Example 14 | 14 | N | 14 | A | 28 | 50 |
| Example 15 | 16.25 | N | 16.25 | A | 32.5 | 50 |
| Example 16 | 16.25 | N | 16.25 | A | 32.5 | 50 |
| Example 17 | 0 | — | 33.75 | A | 33.75 | 100 |
| Example 18 | 0 | — | 33.75 | A | 33.75 | 100 |
| Example 19 | 8.44 | N | 25.31 | A | 33.75 | 75 |
| Example 20 | 8.44 | N | 25.31 | A | 33.75 | 75 |
| Example 21 | 8.44 | N | 25.31 | A | 33.75 | 75 |
| Comparative Example 1 | 33.75 | N | 0 | — | 33.75 | 0 |
| Comparative Example 2 | 33.75 | N | 0 | — | 33.75 | 0 |
| Comparative Example 3 | 33.75 | N | 0 | — | 33.75 | 0 |

TABLE 1B

| | Hexamine [wt %] | Catalyst [wt %] | Catalyst type | Glass fiber [wt %] | Glass bead [wt %] | Chemical resistance |
|---|---|---|---|---|---|---|
| Example 1 | 3.00 | 0.25 | P | 50 | 25 | −0.017 |
| Example 2 | 3.75 | 0.25 | P | 50 | 25 | −0.019 |
| Example 3 | 3.75 | 0.25 | P | 50 | 25 | −0.015 |
| Example 4 | 3.00 | 0.75 | P | 50 | 25 | −0.014 |
| Example 5 | 3.00 | 0.75 | P | 50 | 22 | −0.021 |
| Example 6 | 4.20 | 0.84 | P | 50 | 22 | −0.015 |
| Example 7 | 4.20 | 0.84 | S | 50 | 22 | −0.032 |
| Example 8 | 4.20 | 0.84 | S | 50 | 22 | −0.037 |
| Example 9 | 4.20 | 0.84 | S | 50 | 22 | −0.029 |
| Example 10 | 4.48 | 0.84 | S | 50 | 22 | −0.032 |
| Example 11 | 4.20 | 0.84 | S | 50 | 22 | −0.044 |
| Example 12 | 3.92 | 0.84 | S | 50 | 22 | −0.039 |
| Example 13 | 4.20 | 0.84 | S | 50 | 22 | −0.046 |
| Example 14 | 4.48 | 0.84 | S | 50 | 22 | −0.048 |
| Example 15 | 4.55 | 0.975 | — | 50 | 17.5 | −0.049 |
| Example 16 | 4.88 | 0.975 | — | 50 | 17.5 | −0.042 |
| Example 17 | 4.05 | 0 | — | 50 | 16.25 | −0.021 |
| Example 18 | 4.56 | 0 | — | 50 | 16.25 | −0.033 |
| Example 19 | 4.05 | 0 | — | 50 | 16.25 | −0.031 |
| Example 20 | 4.56 | 0 | — | 50 | 16.25 | −0.042 |
| Example 21 | 4.56 | 0 | — | 50 | 16.25 | −0.046 |
| Comparative Example 1 | 4.05 | 0 | — | 50 | 16.25 | −0.078 |
| Comparative Example 2 | 4.05 | 0 | — | 50 | 16.25 | −0.072 |
| Comparative Example 3 | 4.05 | 0 | — | 50 | 16.25 | −0.071 |

Chemical resistance(%)=(L2−L1)/L1*100

L1: The length of the sample piece before the test

L2: The length of the sample piece after the test

TABLE 2

Examples of Post-Cure Results

| Lot # | Post-Cure Cycle* | Test Bar Appearance | Chemical Resistance After Autoclave Exposure, % (Target: < +/−0.05%) |
|---|---|---|---|
| Example 7A | A | No blisters; normal color | −0.092 |
| Example 7C | C | No blisters; normal color | −0.032 |
| Example 7D | D | Blisters; surface discolored | Not tested due to blisters |
| Example 8B | B | No blisters; normal color | −0.040 |
| Example 8C | C | No blisters; normal color | −0.037 |
| Example 9A | A | No blisters; normal color | −0.072 |
| Example 9C | C | No blisters; normal color | −0.029 |
| Example 9D | D | Blisters; surface discolored | Not tested due to blisters |
| Example 10A | A | No blisters; normal color | −0.097 |
| Example 10C | C | No blisters; normal color | −0.032 |
| Example 10D | D | Blisters; surface discolored | Not tested due to blisters |

*A: 120 C. for 8 hours
150 C. for 4 hours
165 C. for 4 hours
(1 hr. ramp between temps.)
*B: 120 C. for 8 hours
150 C. for 4 hours
165 C. for 4 hours
177 C. for 4 hours
(1 hr. ramp between temps.)
*C.: 120 C. for 8 hours
150 C. for 4 hours
165 C. for 4 hours
177 C. for 16 hours
(1 hr. ramp between temps.)
*D: 120 C. for 4 hours
150 C. for 4 hours TABLE 2-continued Examples of Post-Cure Results

| Lot # | Post-Cure Cycle* | Test Bar Appearance | Chemical Resistance After Autoclave Exposure, % (Target: < +/−0.05%) |
|---|---|---|---|

165 C. for 4 hours
180 C. for 4 hours
(1 hr. ramp between temps.)
**Examples 7A, 7C and 7D are the same as Example 7 on Table 1 in formulation.
**Examples 8B and 8C are the same as Example 8 on Table 1 in formulation.
**Examples 9A, 9C and 9D are the same as Example 9 on Table 1 in formulation.
**Examples 10A, 10C and 10D are the same as Example 10 on Table 1 in formulation.

According to the invention, a scroll can be provided which is mainly made of a resin excellent in abrasion resistance and chemical stability where a refrigerant and a refrigerating machine oil coexist at a high temperature and a high pressure. The scroll compressor using the scroll member according to the invention, though mainly made of a resin, has good chemical stability under high temperature and high pressure refrigerant and refrigerating machine oil, as well as practical abrasion resistance.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined claims set forth below.

What is claimed is:

1. A member for a compressor comprising a phenol group resin and a glass material wherein the dimensional change rate of the member is 0.05% or below under a chemical stability test condition conducted in an atmosphere in which a refrigerant and a refrigerating machine oil coexist at a temperature of 150° C. and a pressure of 3.6 Mpa.

2. The member according to claim 1, wherein the phenol group resin is made of a phenol aralkyl resin.

3. The member according to claim 1, wherein the phenol group resin is made of a combination of a phenol aralkyl resin and a phenol resin.

4. The member according to claim 3, wherein the phenol resin is either a novolac phenol resin or a resol phenol resin.

5. The member according to claim 3, wherein the contained amount of the phenol resin is equal to or less than twice of the contained amount of the phenol aralkyl resin.

6. The member according to claim 1, wherein the glass material is made of a glass fiber.

7. The member according to claim 1, wherein the glass material is made of a combination of a glass fiber and glass beads.

8. The member according to claim 7, wherein the contained amount of the glass fiber is equal to or more than the contained amount of the glass beads.

9. The member according to claim 1, wherein the phenol group resin amounts to 25 to 35% by weight and the glass material amounts to 55 to 75% by weight.

10. The member according to claim 1, wherein the phenol group resin amounts to 25 to 35% by weight and the glass material amounts to 55 to 75% by weight.

11. The member according to claim 1, wherein the member is a scroll member for a scroll compressor.

12. A member for a compressor comprising a phenol group resin and a glass material, wherein the member is formed by heat treatment having stepwise temperature increase of a molded material from an initial temperature range of 120 to 140° C. to a final temperature range of 170 to 177° C.

13. The member according to claim 12, wherein the heat treatment is implemented sequentially for four hours or more at a temperature range of 120 to 140° C., for four hours or more at a temperature range of 140 to 170° C., and for four hours or more at a temperature range of 170 to 177° C.

14. The member according to claim 13, wherein the heat treatment is implemented at two temperatures in the temperature range of 140 to 170° C. for fours hours or more in total.

15. The member according to claim 12, wherein the molded material is molded by either of injection molding, compression molding and injection compression molding.

16. The member according to claim 12, wherein the phenol group resin is made of a phenol aralkyl resin.

17. The member according to claim 12, wherein the phenol group resin is made of a combination of a phenol aralkyl resin and a phenol resin.

18. The member according to claim 17, wherein the phenol resin is either a novolac phenol resin or a resol phenol resin.

19. The member according to claim 17, wherein the contained amount of the phenol resin is equal to or less than twice of the contained amount of the phenol aralkyl resin.

20. The member according to claim 12, wherein the glass material is made of a glass fiber.

21. The member according to claim 12, wherein the glass material is made of a combination of a glass fiber and glass beads.

22. The member according to claim 21, wherein the contained amount of the glass fiber is equal to or more than the contained amount of the glass beads.

23. The member according to claim 12, wherein the member is a scroll member for a scroll compressor.

24. A method for manufacturing a scroll member in a scroll compressor comprising the steps of:

molding a mixture containing a phenol aralkyl resin and a glass fiber, and implementing a heat treatment under a condition that the dimensional change rate of the member is 0.05% or below under a chemical stability test condition conducted in an atmosphere in which a refrigerant and a refrigerating machine oil coexist at a temperature of 150° C. and a pressure of 3.6 MPa.

25. The method according to claim 24, wherein the heat treatment includes a stepwise temperature increase from an initial temperature range of 120 to 140° C. to a final temperature range of 170 to 177° C.

26. The method according to claim 24, wherein the heat treatment is implemented sequentially for four hours or more at a temperature range of 120 to 140° C., for four hours or more at a temperature range of 140 to 170° C., and for four hours or more at a temperature range of 170 to 177° C.

27. The method according to claim 26, wherein the heat treatment is implemented at two temperatures in the temperature range of 140 to 170° C. for fours hours or more in total.

28. The method according to claim 24, wherein the mixture further contains either or both of a phenol resin and glass beads.

29. A scroll compressor comprising a compression chamber and a scroll member, wherein the scroll member is made of a phenol group resin and a glass material wherein the dimensional change rate of the member is 0.05% or below under a chemical stability test condition conducted in an atmosphere in which a refrigerant and a refrigerating machine oil coexist at a temperature of 150° C. and a pressure of 3.6 MPa.

30. A scroll compressor comprising a compression chamber and a scroll member, wherein the scroll member is formed by the steps of:

molding a mixture containing a phenol aralkyl resin and a glass fiber, and implementing a heat treatment under a condition that the dimensional change rate of the member is 0.05% or below under a chemical stability test condition conducted in an atmosphere in which a refrigerant and a refrigerating machine oil coexist at a temperature of 150° C. and a pressure of 3.6 MPa.

* * * * *

UNITED STATES PATENT AND TRADEMARK OFFICE

CERTIFICATE OF CORRECTION

PATENT NO. : 6,190,146 B1
DATED : February 20, 2001
INVENTOR(S) : Richard P. Heggs et al.

It is certified that error appears in the above-identified patent and that said Letters Patent is hereby corrected as shown below:

Column 11, claim 10,
Line 1, "claim 1" should read -- Claim 12 --.

Signed and Sealed this

Fifth Day of February, 2002

*Attest:*

*Attesting Officer*

JAMES E. ROGAN
*Director of the United States Patent and Trademark Office*